US008401413B2

(12) United States Patent
Maruko et al.

(10) Patent No.: US 8,401,413 B2
(45) Date of Patent: Mar. 19, 2013

(54) IMAGE FORMING DEVICE HAVING A MOVING SECTION

(75) Inventors: Masami Maruko, Hachioji (JP); Susumu Okui, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 344 days.

(21) Appl. No.: 12/810,833

(22) PCT Filed: Jul. 21, 2009

(86) PCT No.: PCT/JP2009/063035
§ 371 (c)(1),
(2), (4) Date: Jun. 25, 2010

(87) PCT Pub. No.: WO2010/021219
PCT Pub. Date: Feb. 25, 2010

(65) Prior Publication Data

US 2010/0278551 A1 Nov. 4, 2010

(30) Foreign Application Priority Data

Aug. 18, 2008 (JP) ..... 2008-209665

(51) Int. Cl.
*G03G 15/20* (2006.01)

(52) U.S. Cl. ..... 399/68; 399/16

(58) Field of Classification Search ..... 399/68, 399/69, 43, 16
See application file for complete search history.

(56) References Cited

U.S. PATENT DOCUMENTS

| | | | | |
|---|---|---|---|---|
| 6,246,858 | B1 * | 6/2001 | Condello et al. | 399/329 |
| 7,916,346 | B2 * | 3/2011 | Matsuzaki et al. | 358/1.9 |
| 2005/0271432 | A1 | 12/2005 | Chiba | |
| 2007/0140751 | A1 * | 6/2007 | Eun et al. | 399/322 |
| 2008/0158606 | A1 | 7/2008 | Matsuzaki et al. | |
| 2008/0253785 | A1 * | 10/2008 | Yamamoto et al. | 399/68 |

FOREIGN PATENT DOCUMENTS

| | | |
|---|---|---|
| JP | 5-173445 | 7/1993 |
| JP | 2003-131524 | 5/2003 |
| JP | 2004-287317 | 10/2004 |
| JP | 2005-351939 | 12/2005 |

(Continued)

OTHER PUBLICATIONS

First Office Action issued Jul. 13, 2011. By the Chinese Patent Office in Application No. 200980101500,1 and English translation thereof (11 pages).

(Continued)

*Primary Examiner* — Sophia S Chen
(74) *Attorney, Agent, or Firm* — Finnegan, Henderson, Farabow, Garrett & Dunner, L.L.P.

(57) ABSTRACT

Disclosed is an image forming device which can prevent occurrence of damage on the surface of a fixing roller or a fixing belt due to the contact of the end of a sheet with the fixing roller or fixing belt. The image forming device, for transferring a toner image to a sheet fed out from a sheet feed section and fixing the toner image to the sheet by pressing the sheet carrying the toner image at a fixing section, includes a moving section for moving the sheet and or the fixing section in the direction at right angles to the traveling direction of the sheet within a preset moving range, the moving section being controlled based on a preset operation pattern.

7 Claims, 8 Drawing Sheets

FOREIGN PATENT DOCUMENTS

| | | |
|---|---|---|
| JP | 2007-148336 | 6/2007 |

OTHER PUBLICATIONS

Japanese Office Action dated Mar. 27, 2012 in corresponding Japanese patent application No. 2010-510006.

English-language International Search Report from the Japanese Patent Office mailed Aug. 25, 2009, for International Application No. PCT/JP2009/063035.

Supplementary European Search Report mailed Aug. 23, 2012 in counterpart European Application No. EP 09 80 8155, 6 pages.

* cited by examiner

IMAGE FORMING DEVICE HAVING A MOVING SECTION

CROSS REFERENCE TO RELATED APPLICATIONS

This application is a national phase application based on International Application No. PCT/JP2009/063035, filed Jul. 21, 2009, which claims the priority of Japanese Patent Application No. 2008-209665, filed Aug. 18, 2008, the content of both of which is incorporated herein by reference.

TECHNICAL FIELD

The present invention relates to an image forming apparatus such as a photocopier and printer provided with a fixing section for performing fixing operations by pressing the sheet carrying an unfixed toner image.

BACKGROUND ART

In many of the image forming apparatuses using the electrophotographic process, a sheet carrying a toner image is pressed and heated by the fixing section provided with an oppositely arranged roller or belt, whereby the image is fixed onto the sheet.

The roller or belt used in such a fixing section is heavily pressed against the sheet at the time of fixing operation. The surface of the roller or belt may be scratched, and the scratch may be reflected on the image on the sheet.

The aforementioned scratch often occurs in the area where the surface of the roller or belt and the respective ends, of the sheet, in the traveling direction (hereinafter referred to as "side end" for short) come in contact frequently. Thus, a scratch generated on the surface of the roller or belt by the contact with the side end of the smaller-sized sheet will appears on a fixed image when that image is formed on a larger-sized sheet.

In one of the proposed techniques to reduce the occurrence of scratches on the surface of the roller or belt, the roller or belt is moved in a direction perpendicular to the traveling direction of sheets, thereby preventing the side end of the sheets from repeatedly contacting a particular area on the surface of the roller or belt (Patent Documents 1 and 2).

However, the scratches appear on the surface of the roller or belt have a characteristic distribution of their positions of occurrence. A desired advantage may not be obtained by the technical means in which the contact area where the side ends of the sheets contact with the roller or belt by moving the roller or belt in a direction perpendicular to the traveling direction of sheets at a predetermined pitch or at a uniform speed.

RELATED ART DOCUMENT

Patent Document

Patent Document 1: Laid-open Japanese Patent Application Publication No. 2004-287317

Patent Document 2: Laid-open Japanese Patent Application Publication No. 2007-148336

SUMMARY OF THE INVENTION

Object of the Invention

In view of the problems described above, it is an object of the present invention to implement an image forming apparatus where the position of contact between the side end of a sheet and a fixing roller or belt is modified according to a preset pattern, where scratches to be generated on the surface of the fixing roller or belt are reduced.

Means For Solving the Object

The aforementioned object can be achieved by the implementation of the following inventions.

Item 1. An image forming apparatus in which a toner image is transferred onto a sheet fed out from a paper feed section and the sheet carrying thereon the toner image is pressed by a fixing section so that the toner image is fixed on the sheet, the image forming apparatus comprising:

a moving section for moving at least one of the sheet and the fixing section within a predetermined moving range in a direction perpendicular to a traveling direction of the sheet; and a control section for controlling the moving section according to a predetermined operation pattern.

Item 2. The image forming apparatus of item 1, wherein the operation pattern is made to cause a side end, of the sheet, parallel to the traveling direction of the sheet to travel on a central portion of the moving range more frequently than on both end portions of the moving range.

Item 3. The image forming apparatus of item 1, wherein the operation pattern is made to indicate a relationship between a position of a side end, of the sheet, parallel to the traveling direction of the sheet and a speed of movement driven by the moving section.

Item 4. The image forming apparatus of item 1, wherein the operation pattern is made to indicate a relationship between a position of a side end, of the sheet, parallel to the traveling direction of the sheet and a moving distance of one movement driven by the moving section.

Item 5. The image forming apparatus of item 1, wherein the operation pattern is made to indicate a relationship between a position of a side end, of the sheet, parallel to the traveling direction of the sheet and timing when the moving section starts to move.

Item 6. The image forming apparatus of item 1, wherein the operation pattern is made to indicate a cyclical change of the moving range.

Item 7. The image forming apparatus of item 1, wherein a setting of the operation pattern can be changed.

Item 8. The image forming apparatus of item 1, wherein the control section is configured to store a plurality of the operation patterns, and is configured to select the operation patterns depending on an accumulated number of prints which were outputted by the image forming apparatus.

Advantage of the Invention

The present invention minimizes scratches on the surface of a fixing roller or belt of a fixing section in an image forming apparatus where a toner image is transferred to a sheet fed out of a sheet feeding section, and the sheet carrying the toner image is pressed by the fixing section to fix the toner image.

EMBODIMENT FOR CARRYING OUT THE INVENTION

Figure 1:
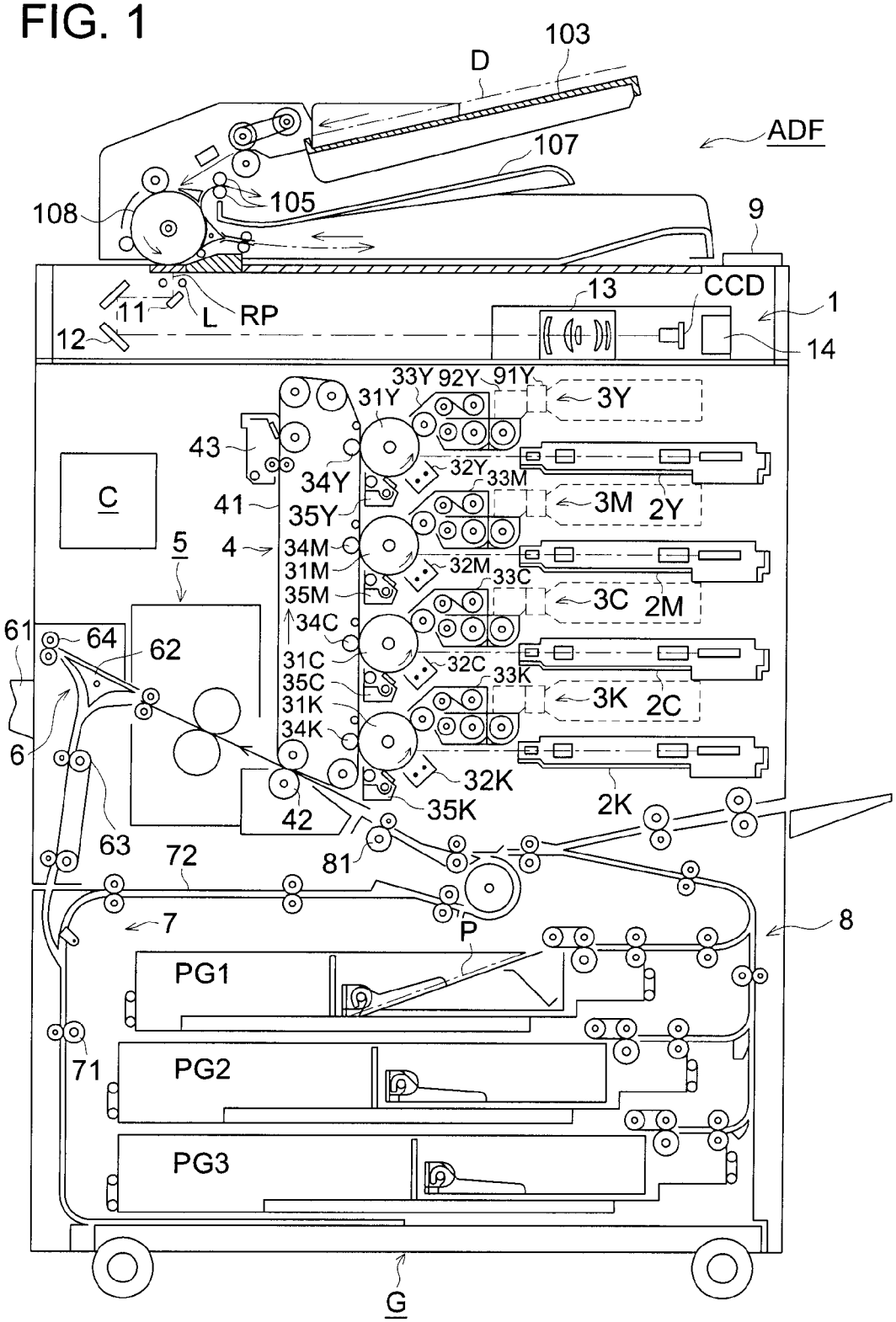
FIG. 1 is a schematic diagram representing an image forming apparatus G.

Referring to the drawings, the following describes the examples of the embodiments according to the present invention, without the present invention being restricted thereto.

FIG. 1 is a schematic diagram representing an image forming apparatus G.

The color image forming apparatus G illustrated in the diagram is what is commonly called the tandem color image forming apparatus wherein a plurality of photoreceptors 31Y; 31M, 31C, and 31K arranged vertically in a raw, being opposed to one intermediate transfer belt 41 to form a full-color image.

An automatic document feed apparatus ADF is provided on the top of the color image forming apparatus G.

The documents D placed on the document platen 103 of the automatic document feed apparatus ADF are separated one by one and are fed out to the document conveyance path, and are conveyed by a conveyance drum 108.

The image for the document D being conveyed is read at the document image reading position RP by means of a document reading section 1. The document D having been read is ejected to a document ejection table 107 by a plurality of conveyance guides and document ejection roller 105.

The image forming apparatus G includes a document reading section 1, exposure sections 2Y, 2M, 2C and 2K, image forming sections 3Y, 3M, 3C and 3K, intermediate transfer section 4, fixing section 5, reversing ejection section 6, sheet re-feed section 7, sheet feed section 8, and control section C. These components are housed in one enclosure.

In the document reading section 1, the document image si irradiated by a lamp L at the document image reading position RP. The light reflected therefrom is led by a first mirror unit 11, second mirror unit 12, and lens 13, and the image is formed on the light receiving surface of the image pickup element CCD.

The image signal photoelectrically converted by the image pickup element CCD is subjected to analog-to-digital conversion, shading correction and compression by an image reading control section 14, and is stored in the memory of a control section C as image data.

The image data stored in the memory is subjected to appropriate image processing depending on the conditions set by the user, and output image data is produced.

The exposure sections 2Y, 2M, 2C, and 2K includes a laser light source, polygon mirror, and a plurality of lenses, and generate laser beams.

In response to the output information outputted based on the data sent from the control section C the exposure sections 2Y, 2M, 2C, and 2K use laser beams to scan and expose the surface of the photoreceptors 31Y, 31M, 31C, and 31K as components of the image forming sections 3Y, 3M, 3C, and 3K.

A latent image is formed on the photoreceptors 31Y, 31M, 31C, and 31K by scanning and exposure with the laser beam.

The image forming section 3Y includes a photoreceptor 31Y, main charging section 32Y, development section 33Y, first transfer roller 34Y, and cleaning section 35Y arranged around the photoreceptor 31Y. The same descriptions are given to the photoreceptors 31M, 31C, and 31K also have the same structure.

The latent images on the photoreceptors 31Y, 31M, 31C, and 31K are developed by the corresponding development section 33Y, 33M, 33C and 33K, and a toner image is formed on each of the photoreceptors.

The toner images formed on the photoreceptors 31Y, 31M, 31C, and 31K are sequentially transferred to a predetermined position of the intermediate transfer belt 41 as an intermediate transfer member by the first transfer rollers 34Y, 34M, 34C, and 34K of the intermediate transfer section 4.

Residual toner is removed by the cleaning sections 35Y, 35M, 35C, and 35K from the surface of the photoreceptors subsequent to the transfer of the toner image.

In the meantime, the toner image transferred to the intermediate transfer belt 41 is transferred by the transfer roller 42 onto the sheet P conveyed from the sheet feed trays PG1, PG2, and PG3 and fed out by a sheet feed roller 81 at an appropriate timing.

The surface of the intermediate transfer belt 41 having finished the transfer of the toner image onto the sheet P is cleaned by a belt cleaning section 43 in a step of preparation for transfer of the next image.

The sheet P carrying the toner image is fed to the fixing section 5, and is pressed and heated by the roller or belt arranged at the opposing position, whereby the toner image is fixed on the sheet P.

The sheet P having been subjected to the process of fixing by the fixing section 5 is guided by the sheet conveyance path switch 6, and is ejected to the ejecting tray 61.

In the case of ejecting the reversed sheet P, the sheet P is led downward by an ejection guide 62, the trailing edge of the sheet P is sandwiched by an ejecting/reversing roller 63, and the sheet P is then reversed and is led to an ejection roller 64 by the ejection guide 62, whereby the sheet P is ejected.

When an image is to be formed on the back side of the sheet P, the sheet P subsequent to fixing of the image on the surface thereof is conveyed to the sheet re-feed section 7 located downward of the ejection guide 62. The trailing edge of the sheet P is sandwiched by a sheet re-feed/reversing roller 71. After that, the sheet P is fed in the reverse direction, whereby the sheet P is reversed and is fed to the sheet re-feed conveyance path 72.

Figure 2:
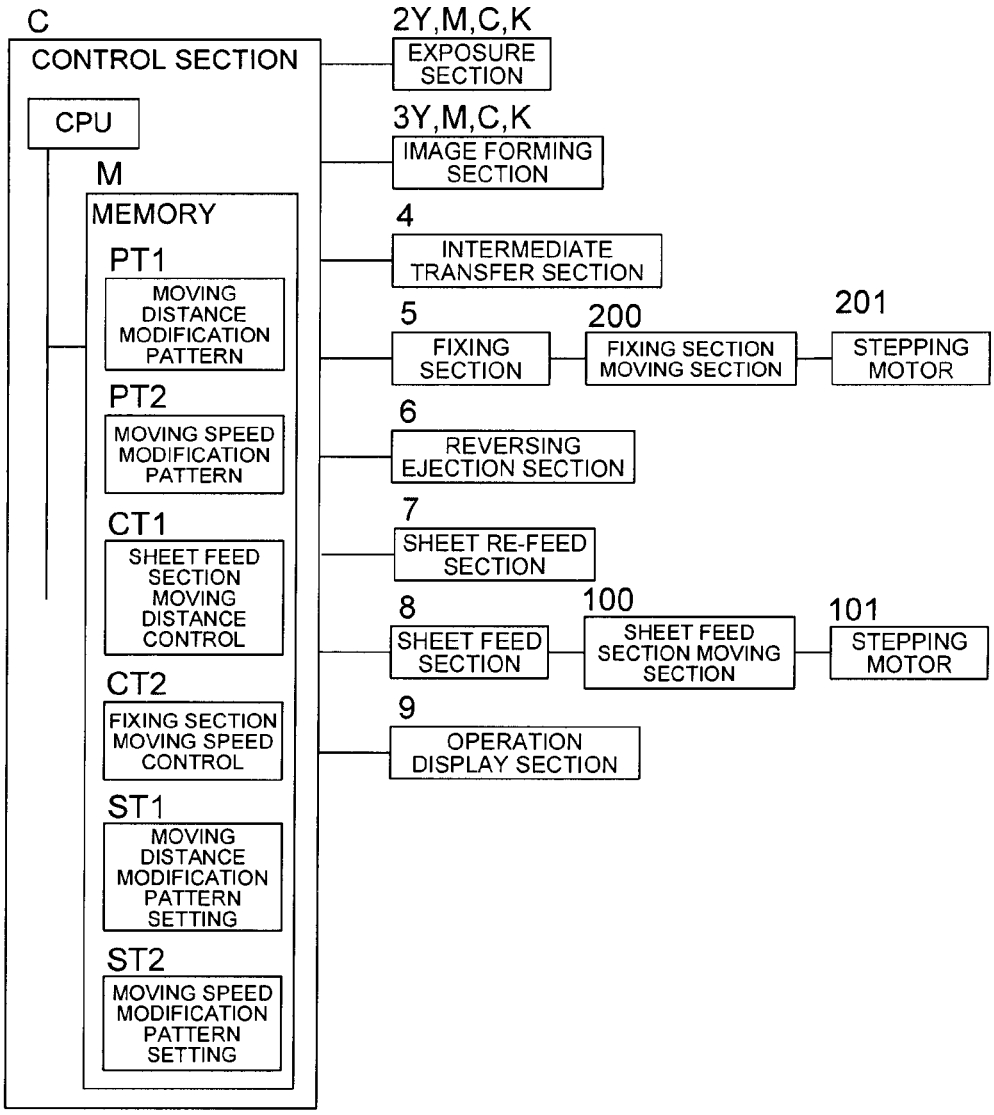
FIG. 2 is a block diagram representing the control system.

FIG. 2 is a block diagram representing a control system of the image forming apparatus G.

The control section C of the image forming apparatus G is a computer system incorporating a CPU, memory M, arithmetic unit, I/O port, communication interface, and drive circuit.

Control is performed by the control section C running the predetermined program stored in the memory M.

The control section C is connected to the network and exchanges information with the other information processing equipment.

In this diagram, description of the block not directly related to the present invention is omitted.

FIG. 3 is a diagram showing the characteristics of scratches occurring to the fixing section 5.

As described above, the scratch given to the roller or belt of the fixing section 5 is mainly caused by the pressure and contact between the side end of the sheet P and the surface of the roller or belt. Therefore, one of the commonly known techniques is configured to vary the relative position, in the direction perpendicular to the traveling direction of the sheet P, of the sheet P with respect to the fixing section, at the time of fixing.

The same scratch is given to the roller or belt of the fixing section 5, whichever the fixing section 5 is equipped with a roller or a belt. Thus, the following description refers to the roller alone.

Figure 3A:
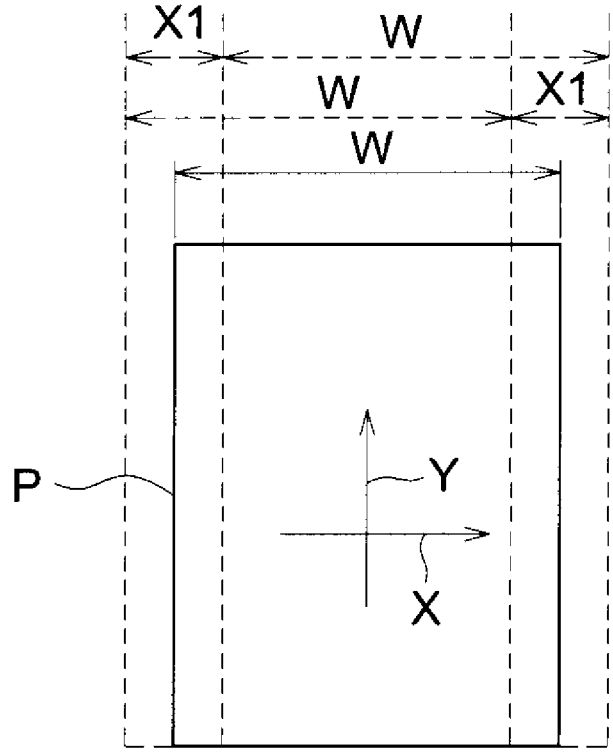
FIGS. 3*a* to 3*c* are diagrams showing the characteristics of scratches occurring on the fixing section.

FIG. 3*a* shows that the sheet P traveling in the direction of arrow Y and the fixing section 5 relatively travels in the direction X perpendicular to the traveling direction Y of the sheet P. Traveling is performed by reciprocal movement at a uniform speed within the moving range X1.

Figure 3B:
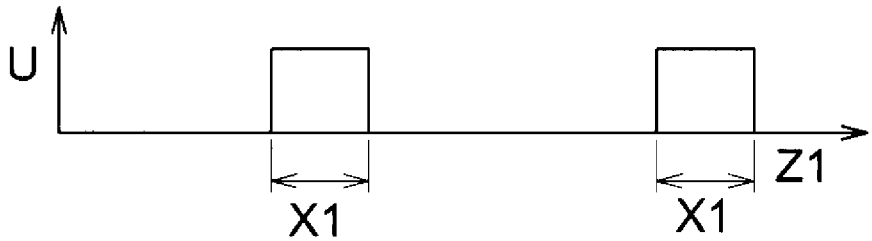

In FIG. 3*b*, the axial direction of the roller of the fixing section 5 is plotted on the horizontal axis Z1. The vertical axis U indicates the frequency of contact of the side end of the sheet P and the surface of the roller, i.e., the traveling frequency of the side end of the sheet P (hereinafter referred to as "contact frequency" for short). To be more specific, the contact frequency is uniform over the moving range X1 in the axial direction of the roller as the contact range.

Figure 3C:
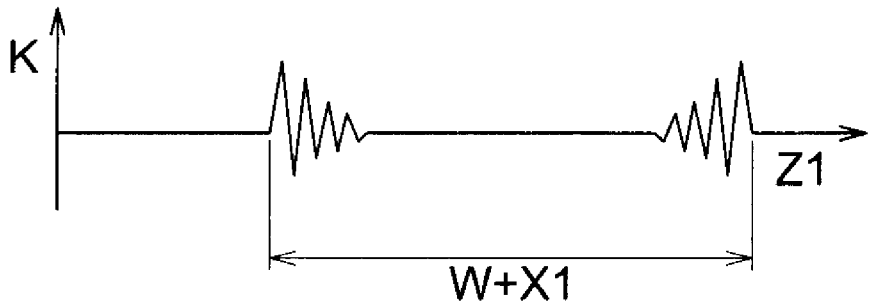

FIG. 3*c* is qualitatively showing the size of the scratch occurring to the roller surface. The vertical axis K indicates the size of scratch, while the horizontal axis Z1 denotes the axial direction of the roller.

As shown in FIG. 3*c*, the scratch given to the roller surface by the pressure and contact between the side end of the sheet P and surface of the roller may be projected or depressed. The size of the scratch is greater as one goes closer to both end portions of the contact range (W+X1) between the sheet P and the roller of the fixing section 5.

Such a form of the given scratches is generated in the situation where the scratch on the roller surface given by the pressure and contact between the side end of the sheet P has been flattened and corrected by the pressure and contact between the surface of the sheet P and surface of the roller.

Thus, heavy scratches are given, in the early stage, close to both end portions of the contact range (W+X1), where the pressure and contact between the plane surface of the sheet P and the surface of the roller is not often. These scratches determine the service life of the roller.

The present invention is made through a closer observation of the characteristics in the occurrence of scratches. This is intended to delay the time of scratches being given and to prolong the service life of the roll by reducing the frequency of the side end of the sheet P passing through the area closer to both end portions of the contact range (W+X1) between the sheet P and the roller of the fixing section 5, and increasing the frequency of the side end of the sheet P passing through the area farther from both end portions of the contact range (W+X1).

Figure 4A:
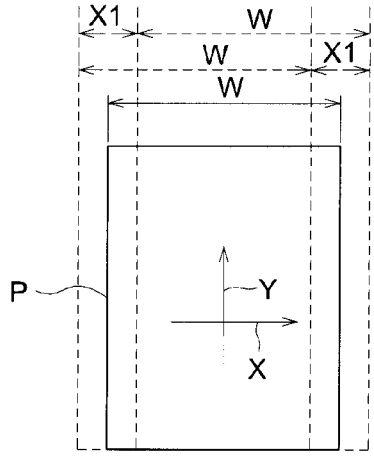
FIGS. 4*a* to 4*c* are diagrams showing the characteristics of moving control in the present invention.
Figure 4B:
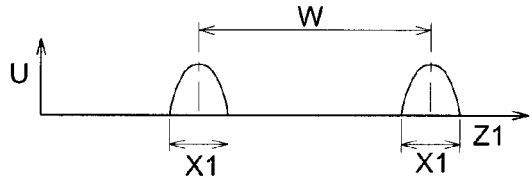

In FIG. 4*b*, the axial direction of the roller of the fixing section 5 is plotted on the horizontal axis Z1. The vertical axis U indicates the contact frequency between the side end of the sheet P and the surface of the roller (frequency of the traveling of the side ends of the sheet P). FIG. 4*b* shows the characteristics of the traveling control in the present invention.

To be more specific, unlike the case of FIG. 3*b* the contact frequency is the highest at the intermediate position of the moving range X1 of the roller in the axial direction, which is the contact range, and is reduced at both end portions of the moving range.

Figure 4C:
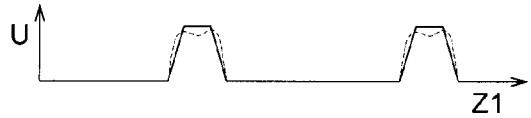

The contact frequency can be indicated by a solid line or dotted line in FIG. 4*c*, for example. The minimum requirement is that the contact frequency should be higher at the intermediate area of the moving range X1 and should be lower at the both end portions of the moving range.

In the process of fixing, the relative position, between the sheet P and fixing section 5, in the direction perpendicular to the traveling direction of the sheet P is varied by moving at least one of the sheet conveyance path in the sheet feed section 8 leading from the sheet feed trays PG1, PG2, and PG3 to the sheet feed roller 81 or the fixing sections 5.

For example, when the leading edge of the sheet P is sandwiched by the sheet feed rollers 81, the conveyance rollers other than the sheet feed roller 81 are released from the conveyance position, and the sheet feed roller 81 is moved in the direction perpendicular to the traveling direction of the sheet P, whereby the sheet P can be moved.

Figure 5:
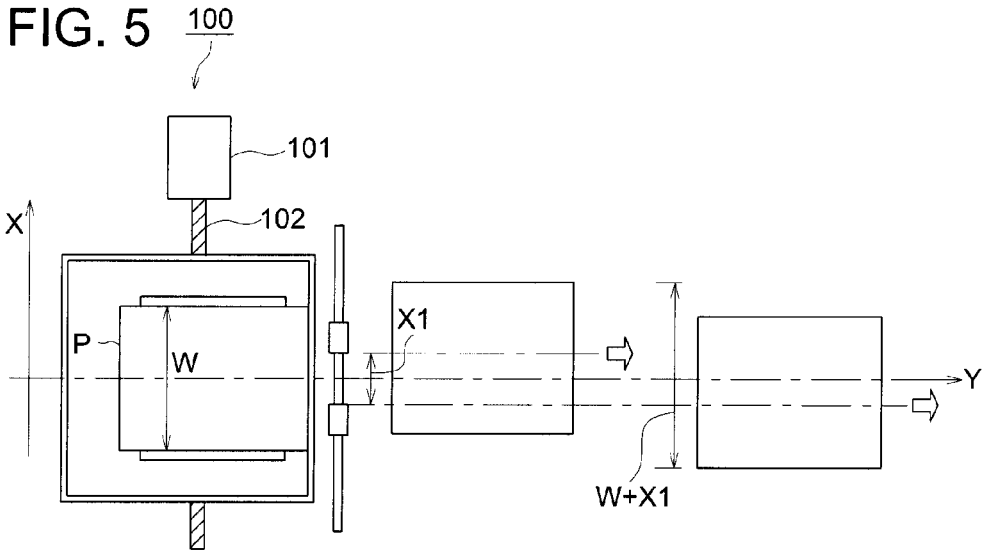
FIG. 5 is a schematic diagram representing a sheet feed section moving section.

FIG. 5 shows an example of moving the sheet P by moving the sheet feed trays PG1, PG2, and PG3 of the sheet feed section 8.

The sheet feed section moving section 100 is a moving section that reciprocally moves the sheet feed trays PG1, PG2, and PG3 in the direction perpendicular to the traveling direction of the sheet P within the moving range X1. The sheet feed section moving section 100 includes a stepping motor 101 and a screw 102.

The sheets P having a width W are placed on the sheet feed trays PG1, PG2, and PG3 of the sheet feed section 8. Below the sheet feed trays PG1, PG2, and PG3 is provided a transmission member (not illustrated) having a screw corresponding to the screw 102 of the sheet feed section moving section 100.

The control section C rotates the screw 102 by a desired angle, driving the stepping motor 101 for every feed of sheet.

The sheet feed trays PG1, PG2, and PG3 provided with the transmission member are moved by a desired distance by the rotation of the screw 102. The moving range in this example is X1.

Figure 6:
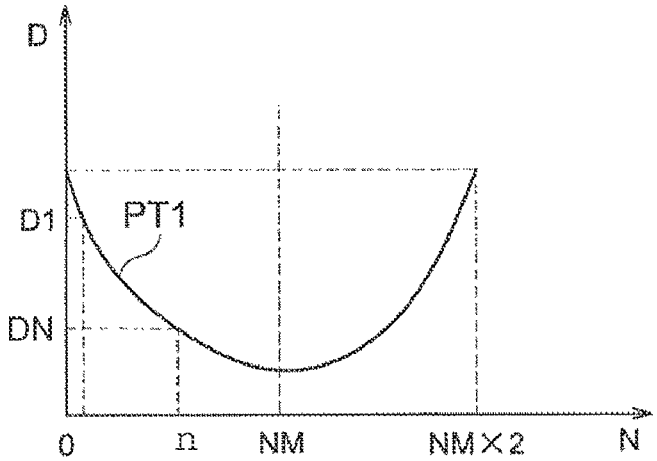
FIG. 6 is a diagram representing an example of the moving distance modification pattern.

FIG. 6 is a diagram representing an example of the moving distance modification pattern.

In FIG. 6, the number of sheets fed by the sheet feed tray is plotted on the horizontal axis N, and the vertical axis D indicates the distance wherein the sheet feed tray is moved for every feed of sheet in the direction perpendicular to the sheet feed direction.

The moving distance modification pattern PT1 is an example of the operation pattern and is preset and stored in the memory M of the control section C. This is referenced when controlling the movement of the sheet feed section moving section 100.

For example, when the first sheet is fed, a predetermined sheet supply tray is moved by the distance D1 corresponding to the number of sheets. When the n-th sheet is fed, the tray is further moved by a distance DN. As will be apparent from the diagram, the moving distance D is reduced with an increase in the number of sheets to be fed.

When the cumulative moving distance of the movement for respective sheet feed has reached half the preset moving range X1 at the timing of the NM-th sheet feed, the moving distance D starts to gradually increase. Then, the cumulative moving distance reaches the end of the moving range X1, when the NM×2-th sheet is fed.

When the cumulative moving distance reaches the end of the moving range X1, the control section C reverses the rotating direction of the stepping motor 101 of the sheet feed section moving section 100, and the moving distance modification pattern PT1 exhibits a gradual decrease of the moving distance when returning. From the NM×3-rd sheet, there is a gradual increase in the moving distance, returning to the starting point when the NM×4th sheet is fed.

When sheet feed further continues, the moving direction of the sheet feed tray is reversed, and the moving distance for each sheet feed is controlled again in conformity to the moving distance modification pattern PT1.

As described above, as sheets are fed with the sheet feed tray moving in the aforementioned manner, the contact position between the side end of the sheet P and the surface of the roller of the fixing section 5 moves within the moving range X1. The interval of the contact positions is greater at the position which is closer to the end of the moving distance X1. This interval is the smallest at the center.

As shown in the diagram, when the position of the sheet feed section is plotted on the horizontal axis, and the distance of one traveling operation by the moving section such as the sheet feed section moving section 100 is plotted on the vertical axis, the moving distance modification pattern displays bilateral symmetry about the vertical axis provided at the intermediate position of the preset moving range of the sheet feed section.

This is the configuration to ensure that the distributions, in the respective moving ranges X1, of the scratches on the surface of the roller caused by the contact with the side end of the sheet P are the same.

Figure 7:
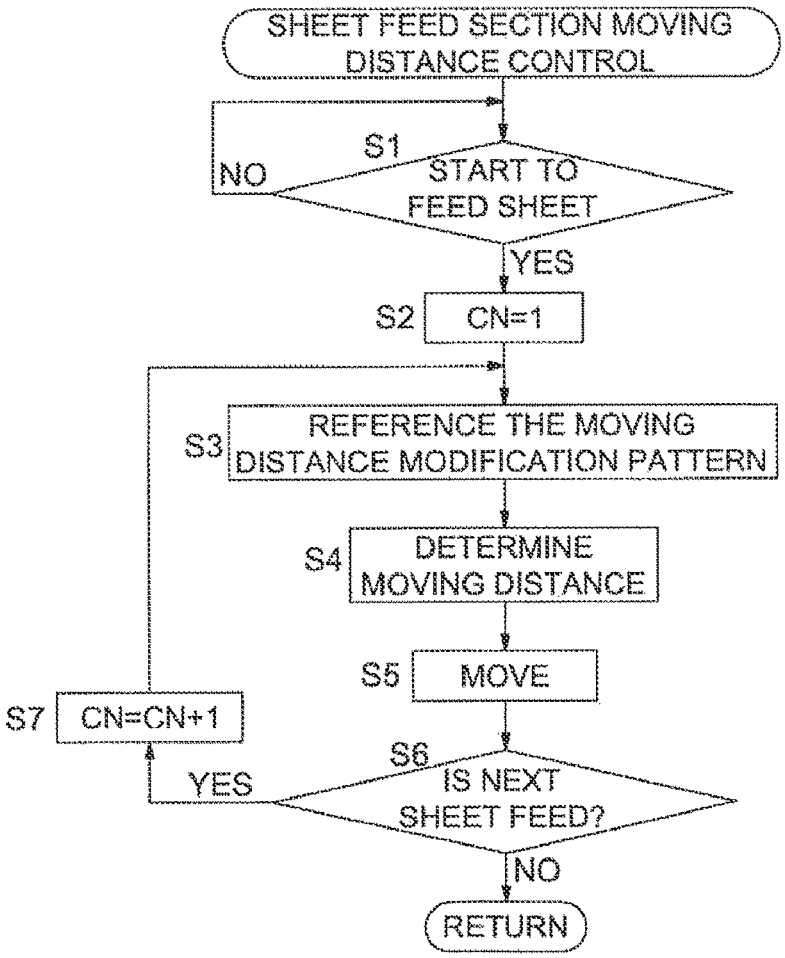
FIG. 7 is a flow chart showing the flow of controlling the moving distance of a sheet feed section.

FIG. 7 is a flow chart showing the flow of the sheet feed section moving distance control CT1.

When the sheet feed start information has been received (Step S1: Y), "1" is set to the number-of-sheets counter CN (Step S2).

The moving distance modification pattern PT1 is referenced (Step S3), and the moving distance is determined (Step S4).

Upon completion of the moving of the sheet feed section corresponding to the moving distance having been determined (Step S5), a step is taken to check if the next sheet is present or not (Step S6).

If sheet feed is to be continued (Step S6: Y), "1" is added to the number-of-sheets counter CN (Step S7). The moving distance modification pattern PT1 is referenced again and the sheet feed section moves (Steps S3 through S5).

If there is no sheet to be fed next (Step S6: N), the operation exits from the process routine.

The aforementioned operation pattern indicates the case wherein the sheets are fed intermittently in the direction perpendicular to the traveling direction of the sheet for each sheet feed. The pattern shows the relationship between the position of the side end of the sheet and the moving distance by one traveling operation of the moving section.

However, any operation pattern is acceptable as long as the frequency of the sheet P being moved through the central portion of the moving range by the movement of the sheet feed trays PG1, PG2, and PG3 is higher than the frequency of being moved through both end portions of the moving range. The present invention is not restricted to the aforementioned example.

In one of the methods for controlling the timing of starting the movement by the moving section, for example, an operation pattern may be set to include certain positions and to indicate a number of sheet to be fed, by a fixed speed, at each certain position. The control may be performed to move by a predetermined distance after a number of sheets indicated by the operation pattern are fed out.

It is also possible to make such arrangements that the operation pattern shows the relationship between the position of the side end of the sheet and the moving speed provided by the moving section. The operation pattern is set in such a way that the moving speed at the central portion of the moving range is smaller. Then the set operation pattern is referenced, and the sheet feed trays PG1, PG2, and PG3 are moved on a continuous basis.

It is also possible to create an operation pattern to cyclically change the moving range in such a way that the frequency of the sheet P traveling inside the minimum moving range is high and the frequency of the sheet P traveling through both end portions of the maximum moving range is low.

The traveling operation can be performed on a continuous basis or on an intermittent basis.

Figure 8:
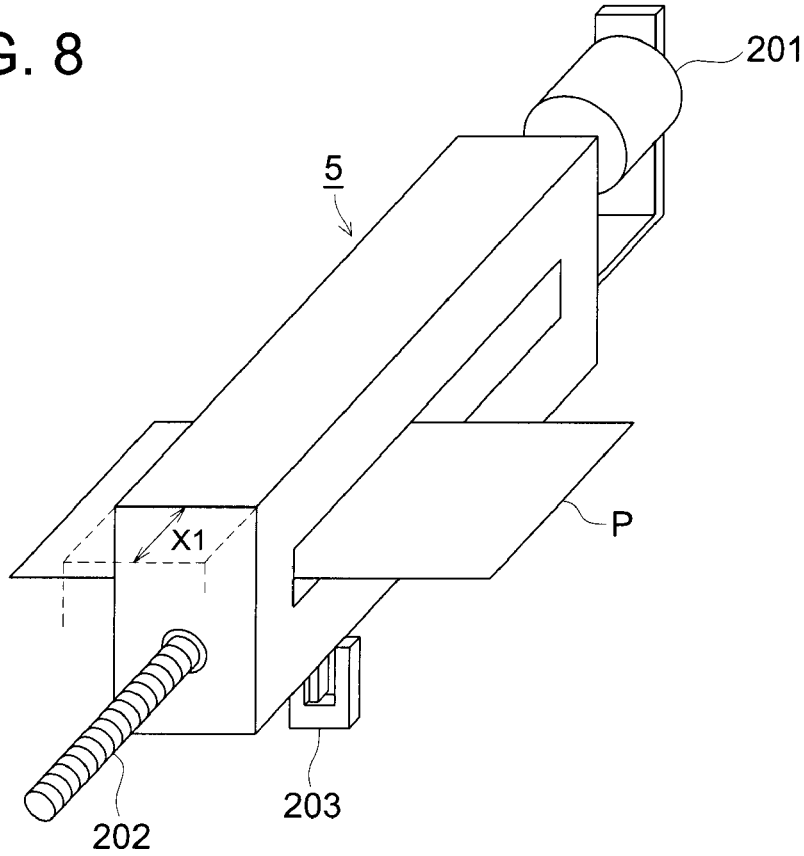
FIG. 8 is a conceptual diagram representing a fixing section moving section.

FIG. 8 is a schematic diagram representing a fixing section moving section 200 for moving the fixing section 5.

The fixing section moving section 200 is a moving section to move the fixing section 5 in the direction perpendicular to the moving direction of the fixing section 5. The fixing section moving section 200 includes a stepping motor 201, a screw 202, and a moving position detection device 203.

The fixing section 5 has a threaded portion to mesh with the screw 202. The fixing section 5 performs reciprocal motion in the moving range X1 in the direction perpendicular to the traveling direction of the sheet P by the rotation of the screw 202. The position of the fixing section 5 in the moving direction is detected by the moving position detection device and the detection information is sent to the control section C.

The screw 202 is driven by the stepping motor 201 whose rotating direction and speed is controlled by the control section C.

The speed of the reciprocal motion of the fixing section 5 is set at a value much lower than that of the traveling speed of the sheet P. Through experiments, the speed is set below the speed at which the conveyance of the sheet P is not be disturbed even if the fixing section 5 is moved during the feed of the sheet P.

Figure 9:
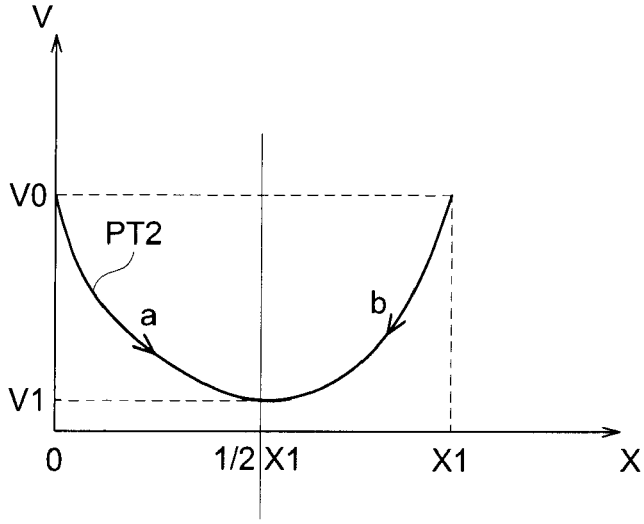
FIG. 9 is a diagram showing an example of the moving speed modification pattern.

FIG. 9 is a diagram showing an example of the moving speed modification pattern PT2.

The moving speed modification pattern PT2 as an example of the operation pattern indicates the relationship between the moving position and the moving speed at that position, where the moving distance of the fixing section 5 is plotted on the horizontal axis X and the moving speed is plotted on the vertical axis V. This pattern is referenced to determine the moving speed of the fixing section 5 by the fixing section moving section 200.

The fixing section 5 starts to move from the starting position at the moving speed V0, which is the highest speed. Then the speed is gradually decreased as indicated by arrow "a". When the fixing section 5 has moved the distance X1/2, which is an intermediate point of the moving range X1, the speed is reduced to the lowest moving speed V1.

After that, the moving speed is gradually increased., and when the fixing section 5 has moved the distance X, the moving speed reaches the highest moving speed V0 and the direction is reversed as indicated by arrow "b" to trace the approach route indicated by arrow "a".

Figure 10:
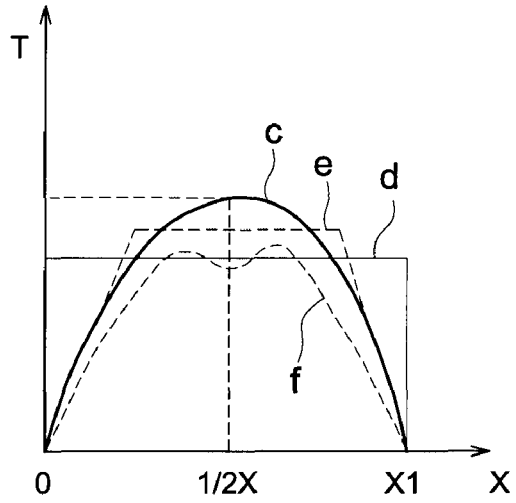
FIG. 10 is a diagram showing the time period of contact between the fixing roller surface and the side end of the sheet.

FIG. 10 is a diagram showing the time period of contact between the fixing roller surface and the side end of the sheet P when the movement of the fixing section 5 is controlled according to the moving speed modification pattern PT2 of FIG. 8. The moving distance is plotted on the horizontal axis X, while the time period of contact is plotted on the vertical axis T.

As indicated in FIG. 10, the time period of the contact between the fixing roller of the fixing section 5 under the moving control according to the moving speed modification pattern PT2, and the side end of the sheet is shorter at the respective end portions of the moving range X1, as indicated by curve "c", and is longer at the portion close to the central portion of the moving range.

The straight line "d" indicates the time period of contact between the fixing roller of the fixing section 5 and the side end of the sheet when the fixing section 5 performs a reciprocal motion at a constant speed.

Although the moving speed modification pattern PT2 preferably is the pattern that implements the curve "c", the moving speed modification pattern PT2 implementing the curve "e" or "f", for example, is acceptable, as long as the time period of contact is shorter at the end portion of the moving range X1, and is longer in apportion close to the center of the moving range.

When the position of the sheet feed section is plotted on the horizontal axis, and the moving speed is plotted on the vertical axis, the moving speed modification pattern exhibits a bilateral symmetry about the vertical axis provided at the intermediate position of the predetermined moving range of the fixing section.

This configuration is intended to ensure that the distribution of the scratches on the surface of the roller caused by the contact with the side end of the sheet P will be equal between the corresponding moving ranges X1 on both sides.

Figure 11:
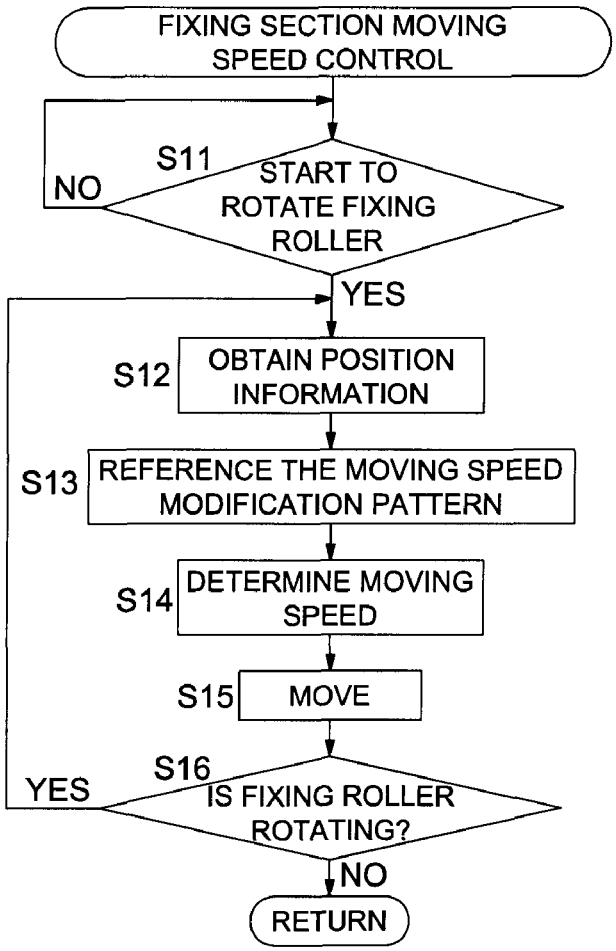
FIG. 11 is a flow chart showing the flow of controlling the moving speed of a fixing section.

FIG. 11 is a flow chart showing the flow of the fixing section moving speed control CT2.

When the fixing roller starts to rotate (Step S11: Y), the moving speed modification pattern PT2 is referenced (Step S13) with respect to the information from the moving position detection device 203 (Step S12) and information on the traveling direction being stored, whereby the moving direction and moving speed are determined (Step S14).

When the fixing section 5 moves at the determined moving speed (Step S15) and the rotation of the fixing roller continues (Step S16: Y), the moving speed modification pattern PT2 is again referenced (Step S13) with respect to the information from the moving position detection device 203 (Step S12) and the information on the moving direction is stored. Then the steps (Steps S14 and 15) are repeated.

When rotation of the fixing roller has stopped (Step S16: N), the process routine terminates.

The aforementioned operation pattern indicates the relationship between the position of the side end of the sheet P and the moving speed. Any operation pattern can be used as long as the frequency of the sheet P traveling through the central portion of the moving range is made higher than that of the sheet P traveling through both end portions of the moving range, by the movement of the fixing section 5. The present invention is not restricted to the aforementioned example.

For example, the operation pattern can be designed to modify the moving range at a predetermined cycle in such a way that the frequency of the sheet P traveling inside the minimum moving range is increased, while the frequency of the sheet P traveling through both end portions of the maximum moving range is decreased.

Figure 12:
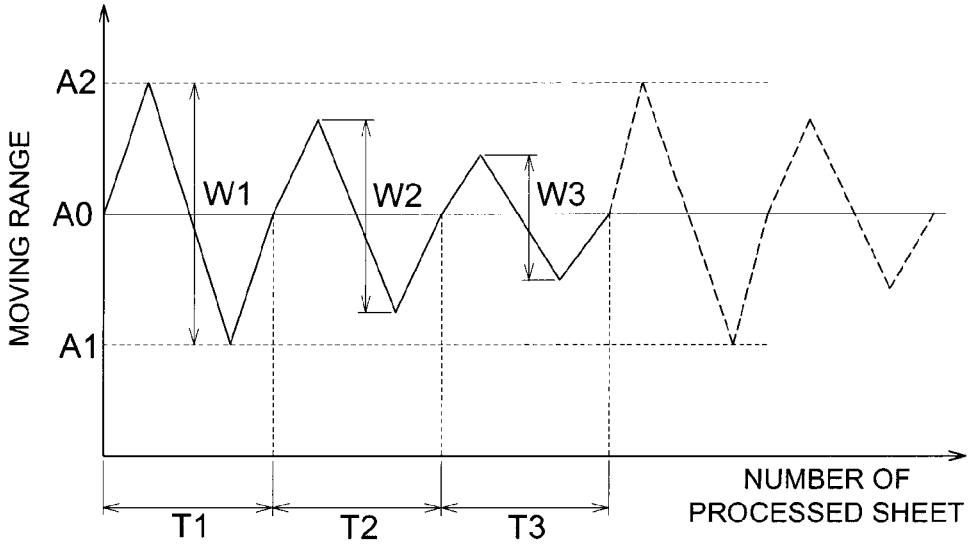
FIG. 12 is a diagram showing an example of the operation pattern for periodically modifying the moving range.

FIG. 12 is a diagram showing an example of the operation pattern for cyclically modifying the moving range.

The operation pattern shown in FIG. 12 indicates an example of modifying the number of sheets and the relative moving range between the sheet P and fixing section 5. The moving range is from A1 to A2, and the center of the moving range is located at A0.

In this example, the movement is performed in the maximum moving range W1 in the first cycle T1, in the moving range W2 in the second cycle T2, and in the minimum moving range W3 in the third cycle T3.

As will be apparent from the diagram, the frequency of the sheet P moving inside the minimum moving range W3 is higher, and the frequency of the sheet P moving through the both end portions of the maximum moving range W3 is lower.

In this example, the operation patterns from the first to third cycles are repeated. It is also possible to make such an arrangement that the operation pattern is changed at every termination of that operation pattern.

For example, the moving range may be increased with the number of sheets having been processed.

Further, the horizontal axis may indicate the operation time and the moving may be performed on a continuous basis as illustrated, or on an intermittent basis. This is determined in the design phase.

Figure 13:
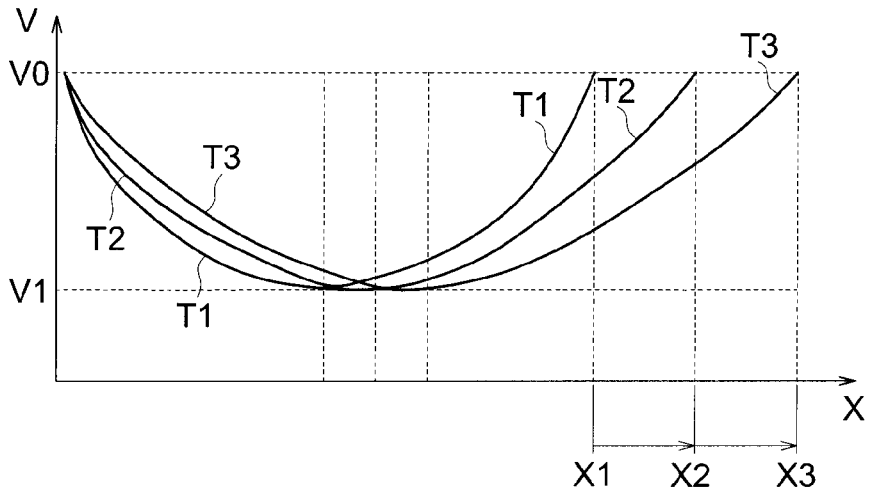
FIG. 13 is a diagram showing an example of the operation pattern for modifying the moving range.

FIG. 13 is a diagram showing an example of the operation pattern for modifying the moving range.

In FIG. 13, when the number of sheets having been processed has been changed, or the time of processing has changed from T1 to T3, the moving range is changed from X1 to X3. The moving range is expanded with an increase in the number of sheets having been processed. The number of sheets having been processed and the time of processing correspond to the cumulative number of prints outputted by the image forming apparatus G.

The moving distance modification pattern PT1 and the moving speed modification pattern PT2 described as examples of the operation patterns are preset in the form of a formula or table in the memory M of the control section C by performing the moving distance modification pattern setting ST1 and the moving speed modification pattern setting ST2 as setting programs which use the operation display section 9 of the image forming apparatus G. The setting can be modified if required.

Such setting and modification are performed based on the result of experiments.

The number of operation patterns to be stored does not need to be one. It is possible to select from a plurality of operation patterns stored. For example, the operation pattern can be selected based on the cumulative number of prints outputted from the image forming apparatus or the operation time having been counted.

The sheet feed section moving section 100 and fixing section moving section are not restricted to the structure of the present invention. It is possible to use the structure of a motor and an eccentric cam disclosed in the Japanese Patent Application Publication No. 2004-287313.

The aforementioned structure and control reduce the occurrence of scratches on a fixing roller or fixing belt of a fixing section of an image forming apparatus, where a toner image is transferred to a sheet fed out from a sheet feed section, and the sheet carrying the toner image having been transferred thereto is pressed by the fixing section, whereby the toner image is fixed.

When control is provided in such a way that the frequency of the side end of the sheet traveling through the central portion of the moving range is higher than the frequency of traveling through both end portioned of the moving range, the scratches given by the pressure of contact between the side end of the sheet P and the surface of the roller are flatted and corrected by the pressure of contact between the flat surface of the sheet P and the surface of the roller. This arrangement reduces the occurrence of scratches on the surfaces of the fixing roller or fixing belt.

Numerals

C Control section
G Image forming apparatus
P Sheet
PT1 Moving distance modification pattern
PT2 Moving speed modification pattern
100 Sheet feed section moving section
200 Fixing section moving section

The invention claimed is:

1. An image forming apparatus, comprising:

a transfer section for transferring a toner image onto a sheet fed out from a paper feed section;

a fixing section for pressing the sheet carrying thereon the toner image so that the toner image is fixed on the sheet;

a moving section for performing a moving operation in which the moving section moves at least one of the sheet and the fixing section within a predetermined moving range in a direction perpendicular to a traveling direction of the sheet, the toner image being fixed on the sheet when the sheet is in the moving range; and a control section for controlling the moving section according to a predetermined operation pattern, wherein the moving operation is performed to move the at least one of the sheet and the fixing section according to the operation pattern so that a moving distance of the at least one of the sheet and the fixing section for one movement of the moving operation varies so that a side end, of the sheet, parallel to the traveling direction of the sheet travels on a central portion of the moving range more frequently than on one of end portions of the moving range.

2. The image forming apparatus of claim 1, wherein according to the operation pattern, the control section controls the moving section such that a moving speed of the moving section is slower at the central portion of the moving range than other part, so that the moving distance of the at least one of the sheet and the fixing section for one movement of the moving operation varies.

3. The image forming apparatus of claim 1, wherein the operation pattern is made to indicate a relationship between a position of the side end of the sheet in the moving range and a moving distance of one movement of the moving operation so that the moving distance of one movement of the moving operation varies.

4. The image forming apparatus of claim 1, wherein the operation pattern is made to indicate a relationship between a position of the side end of the sheet in the moving range and timing when the moving section starts to move, and the controller controls the moving section to vary the timing so that the moving distance of one movement of the moving operation varies.

5. The image forming apparatus of claim 1, wherein the operation pattern is made to indicate a cyclical change of the moving range.

6. The image forming apparatus of claim 1, wherein a setting of the operation pattern can be changed.

7. The image forming apparatus of claim 1, wherein the control section is configured to store a plurality of the operation patterns, and is configured to select one of the operation patterns depending on an accumulated number of prints which were outputted by the image forming apparatus.

* * * * *